US009360276B1

(12) United States Patent
Meek

(10) Patent No.: US 9,360,276 B1
(45) Date of Patent: Jun. 7, 2016

(54) HOLSTER HOLDER

(71) Applicant: Robert Michael Meek, Waynesboro, VA (US)

(72) Inventor: Robert Michael Meek, Waynesboro, VA (US)

( * ) Notice: Subject to any disclaimer, the term of this patent is extended or adjusted under 35 U.S.C. 154(b) by 0 days.

(21) Appl. No.: 14/266,929

(22) Filed: May 1, 2014

Related U.S. Application Data

(60) Provisional application No. 61/822,827, filed on May 13, 2013.

(51) Int. Cl.

| | |
|---|---|
| ***F41C 33/04*** | (2006.01) |
| ***F16M 13/04*** | (2006.01) |
| ***F41C 33/00*** | (2006.01) |
| ***F41C 33/02*** | (2006.01) |

(52) U.S. Cl.
CPC ..... *F41C 33/041* (2013.01); *F16M 13/04* (2013.01); *F41C 33/00* (2013.01); *F41C 33/006* (2013.01); *F41C 33/02* (2013.01)

(58) Field of Classification Search
CPC ..... F41C 33/00; F41C 33/02; F41C 33/006; F41C 33/007; F41C 33/008; F41C 33/04; A45F 3/00; A45F 5/00; F16M 13/04
USPC ..... 248/218.4, 309.2; 42/70.11; 211/64; 224/243, 244, 255, 268, 247, 248, 272, 224/666, 904
See application file for complete search history.

(56) References Cited

U.S. PATENT DOCUMENTS

| | | | | |
|---|---|---|---|---|
| 1,579,552 | A * | 4/1926 | Ludlow | 248/200 |
| 2,655,298 | A * | 10/1953 | Riley | 224/281 |
| 3,265,259 | A * | 8/1966 | Marburger | 224/193 |
| 3,796,358 | A * | 3/1974 | Grubb | 224/255 |
| 3,828,990 | A * | 8/1974 | Baldocchi | 224/193 |
| 4,044,930 | A * | 8/1977 | Petroski | 224/251 |
| 4,461,442 | A * | 7/1984 | Keenan | 248/205.1 |
| 4,466,148 | A | 8/1984 | Jones | |
| 4,483,501 | A * | 11/1984 | Eddy | 248/205.1 |
| 4,521,930 | A | 6/1985 | Henson | |
| 4,591,081 | A * | 5/1986 | Bianchi et al. | 224/192 |
| 4,691,396 | A * | 9/1987 | Hoffman | 5/503.1 |
| 5,111,545 | A * | 5/1992 | Krozal | 5/503.1 |
| 5,421,497 | A * | 6/1995 | Gilmore | 224/198 |
| 5,551,611 | A * | 9/1996 | Gilmore | 224/198 |
| 5,622,295 | A * | 4/1997 | Hellweg et al. | 224/193 |
| 5,743,451 | A * | 4/1998 | Kahn | 224/268 |
| 5,875,944 | A * | 3/1999 | Beletsky | 224/198 |
| 6,330,815 | B1 * | 12/2001 | Duncan | 70/58 |
| D470,211 | S * | 2/2003 | Redict | D22/108 |
| 7,971,762 | B2 * | 7/2011 | Clifton, Jr. | 224/197 |
| 8,387,182 | B2 | 3/2013 | Edelman | |
| 8,533,876 | B2 * | 9/2013 | Bonk | 5/503.1 |
| 8,578,528 | B1 * | 11/2013 | Heare | 5/503.1 |
| 8,727,294 | B1 * | 5/2014 | Harms | 248/346.01 |
| 2004/0045992 | A1 * | 3/2004 | Dohn | 224/673 |
| 2009/0001117 | A1 * | 1/2009 | Rassias | 224/673 |
| 2009/0014484 | A1 * | 1/2009 | Spielberger | 224/196 |
| 2010/0243690 | A1 * | 9/2010 | Lerch | 224/198 |
| 2011/0272539 | A1 | 11/2011 | Yagi | |
| 2012/0255979 | A1 * | 10/2012 | Sitz | 224/243 |

* cited by examiner

*Primary Examiner* — Nkeisha Smith
(74) *Attorney, Agent, or Firm* — Michael Haynes PLC; Michael N. Haynes

(57) ABSTRACT

Certain exemplary embodiments can provide a system, machine, assembly, device, and/or manufacture, such as an ambidextrous and/or reversible holster holder, that can be reversibly configured for mounting a belt-attaching holster to an approximately vertical surface in either a right-hand arrangement or a left-hand arrangement, the belt-attaching holster potentially comprising a belt loop and/or a belt clip.

8 Claims, 6 Drawing Sheets

HOLSTER HOLDER

CROSS-REFERENCES TO RELATED APPLICATIONS

This application claims priority to, and incorporates by reference herein in its entirety, U.S. Provisional Patent Application 61/822,827, filed 13 May 2013.

BRIEF DESCRIPTION OF THE DRAWINGS

A wide variety of potential, feasible, and/or useful embodiments will be more readily understood through the herein-provided, non-limiting, non-exhaustive description of certain exemplary embodiments, with reference to the accompanying exemplary drawings in which:

FIGS. 11A and 10B show a handgun and left-hand holster attached to the holster holder.

FIGURES

Reference Numbers

Figure 1:
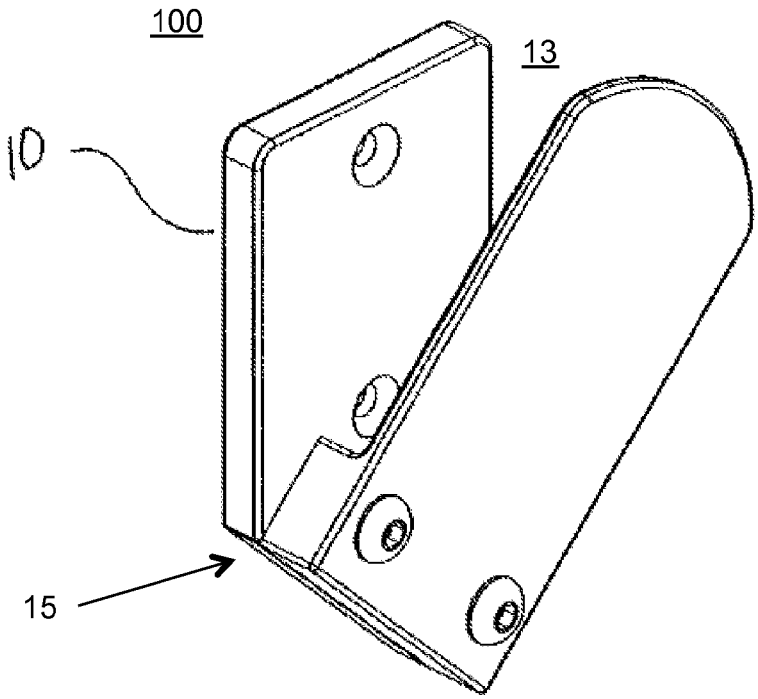
FIG. 1 shows a perspective view of a right-hand assembly of a holster holder.

10 Holster holder assembly for right-hand holster
12 Holster holder assembly for left-hand holster
13 Open end of holster holder assembly
15 Closed end of holster holder assembly
16 Vertical plate portion of the holster holder
18 Angled plate portion of the holster holder
20, 21 Button head screws
22 Double-sided tape
24, 25 Through-holes with counter sinks on both sides
26, 27 Threaded through-holes on a forty-five degree angle
28, 29 Through-holes for clearance
30, 31 Flat-head screws
32 Right-hand holster
34 Left-hand holster
36 Handgun
41, 42 Dominant surfaces of vertical plate portion

DETAILED DESCRIPTION

Certain exemplary embodiments can provide an apparatus or assembly configured for mounting a holstered item at a safe, convenient, and/or concealed location, such as on an interior wall of a closet and/or cabinet.

Certain exemplary embodiments can provide a holster holder that enables a user to keep a holstered item, such as a handgun, safely concealed yet easily accessible. Certain exemplary embodiments of the holster holder can be ambidextrous and/or reversible so the holder can be used for right-hand or left-hand holsters. Certain exemplary embodiments can be used to hold a holster, such as for a handgun, pepper spray, stun gun, knife, baton, handcuffs, radio, telephone, pager, etc. Certain exemplary embodiments can hold almost any holster that has a belt loop or belt clip, simply by removing the holster from the belt and sliding it onto the holder. Later, the holster can be slid off the holder, installed or re-installed on a belt, and/or taken where desired. In the case of a handgun, when the vertical mounting plate portion of the holster holder is mounted to an approximately vertical surface, such as at an approximately ninety degree angle to the horizon (i.e., a surface, planar or curved, that extends in an approximately vertical direction at the mounting point for the vertical mounting plate portion), the handgun can be held at an approximately forty-five degree angle. This approach can secure the holster in a position that substantially prevents the holster from accidentally falling off of the holder and/or can substantially secure the handgun in a ready-to-draw and/or a readily accessible position. This position can allow the user to use a holster without a retention strap, thereby allowing quick and/or easy access to the handgun in case of an emergency while the holster can remain secured in place.

Certain exemplary embodiments of the holster holder can help conceal the user's holstered item and still keep that item at the ready. Utilization of certain exemplary embodiments of the holster holder need not be limited to home security scenarios. Certain exemplary embodiments of the holster holder are compact enough to be used at an office, a garage, a workshop, inside of a recreational vehicle, or even a college dorm room. Certain exemplary embodiments of the holster holder can be mounted on almost any approximately vertical surface, such as on an inside wall of a bedroom closet, coat closet, or kitchen cabinet. Certain exemplary embodiments of the holster holder can be ambidextrous and/or reversible to easily accommodate right-hand and left-hand holsters and/or right- and left-hand walls inside of a closet or cabinet. Certain exemplary embodiments of the holster holder can be mounted to the back of a dresser or night stand, the inside surface of a deep dresser drawer or deep desk drawer, on the right or left inside leg space on an office desk, inside of a storage cabinet, on the back or side of a tool box in a garage or workshop, inside of a closet or cabinet in a recreational vehicle or motorhome, and/or on the inside of a gun safe.

Many holsters are manufactured to include a belt loop or a belt clip to attach the holster to the belt for portable transport or access. Certain exemplary embodiments of the holster holder can use this holster belt loop or clip to affix the holster to the holder.

Figure 2:
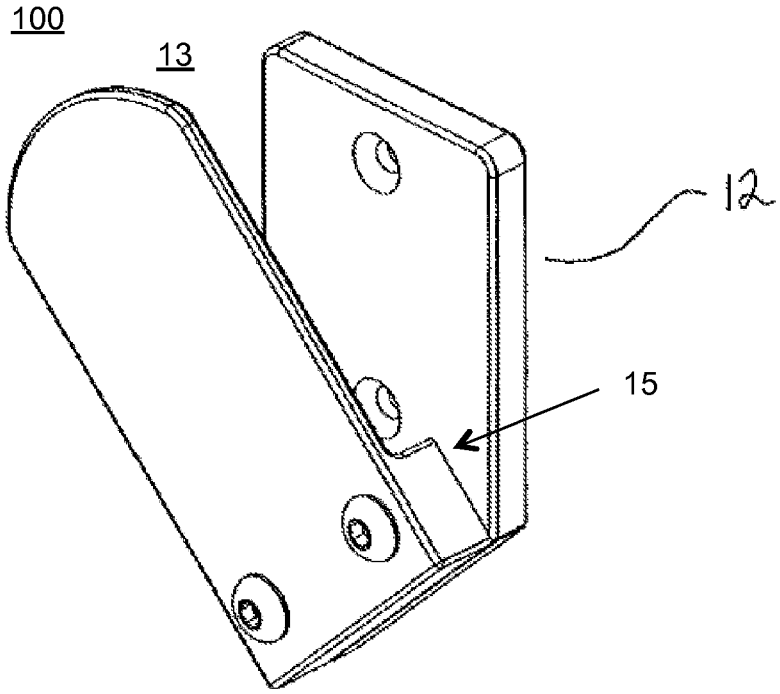
FIG. 2 shows a perspective view of the left-hand assembly of a holster holder.

Referring to FIGS. 1 through 11, a holster holder 100, shown in a right-hand orientation 10 and a left-hand orientation 12, can comprise a reversible vertical mounting plate portion 16, which:

a. is shown in a right-hand orientation in FIG. 1 and a reversed, left-hand orientation in FIG. 2;
b. can be used to mount holster holder 100 to an approximately vertical surface;
c. can be approximately 3⅛" to approximately 4" long, approximately 1⅜" to approximately 2" wide, and/or approximately ¼" to approximately ½" thick.

Figure 3:
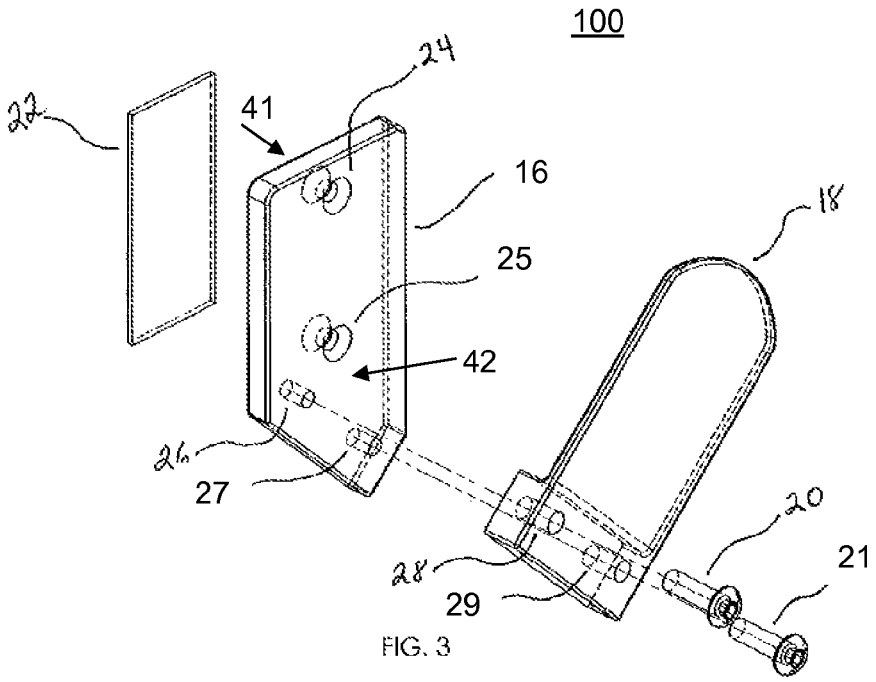
FIG. 3 illustrates the right-hand assembly with double-sided tape.
Figure 4:
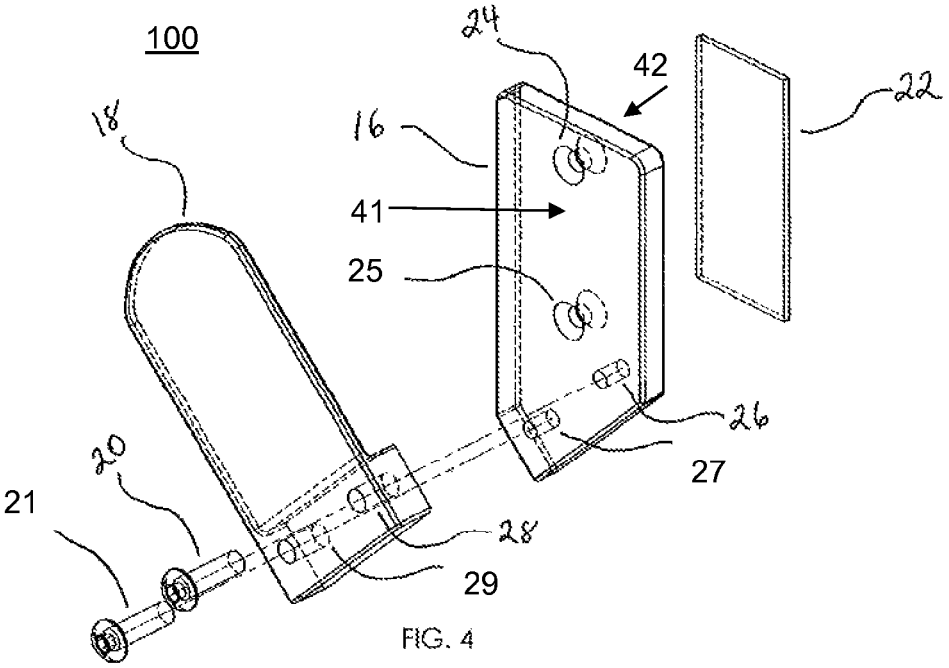
FIG. 4 illustrates the left-hand assembly with double-sided tape.
Figure 5:
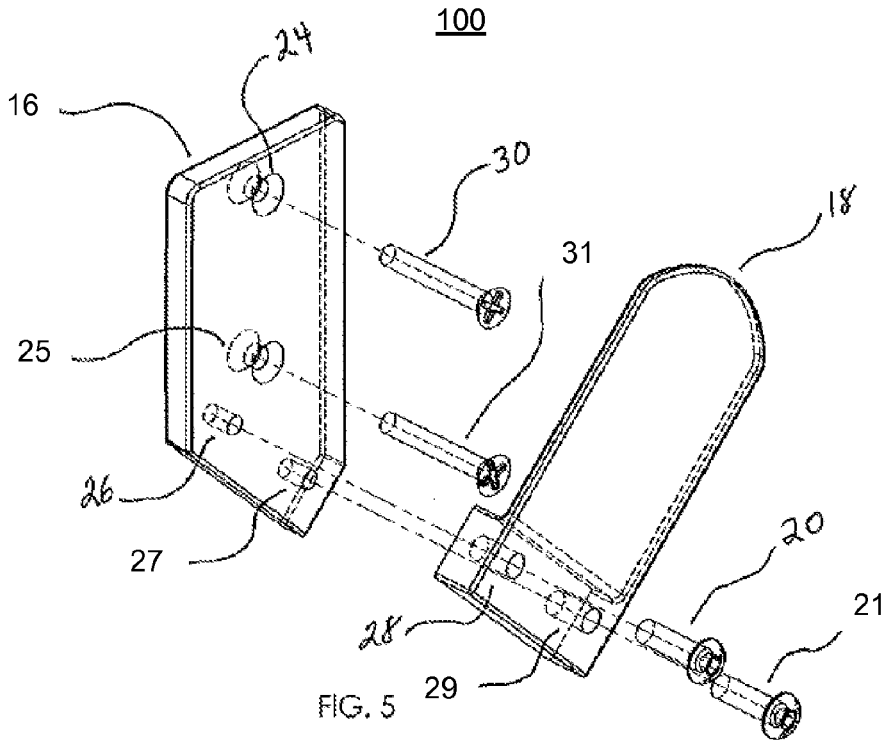
FIG. 5 illustrates the right-hand assembly with the flat-head screws.
Figure 6:
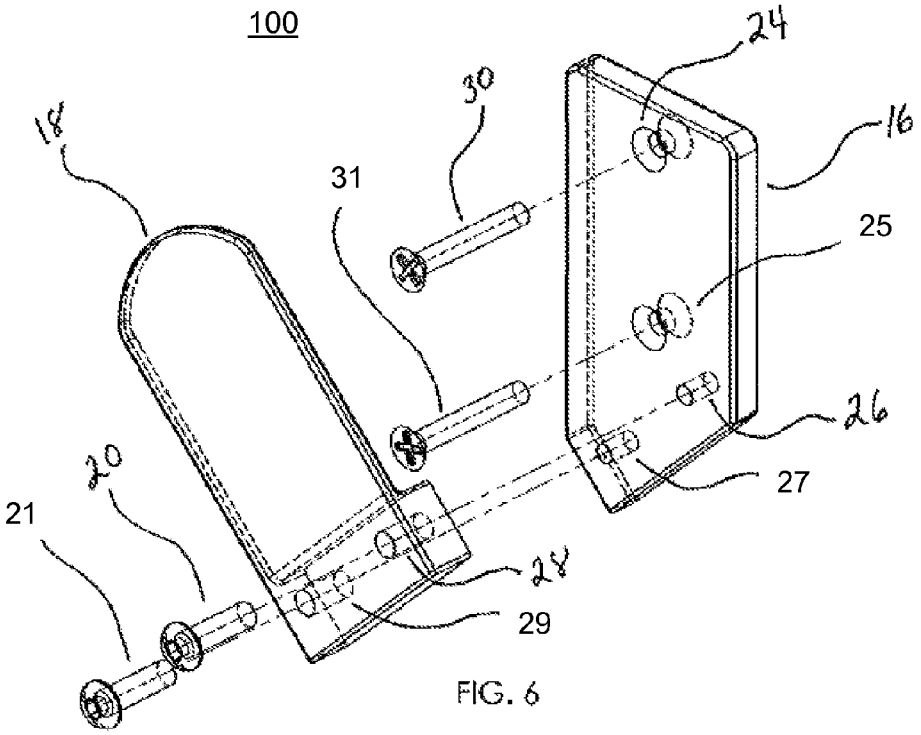
FIG. 6 illustrates the left-hand assembly with the flat-head screw.
Figure 7A:
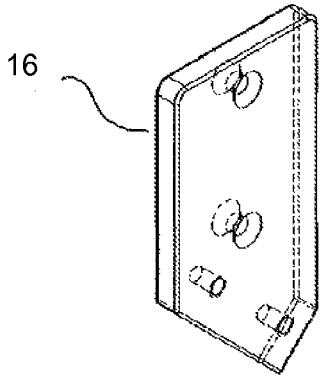
FIGS. 7A, 7B, 7C, and 7D show the vertical plate in the right-hand position.
Figure 7B:
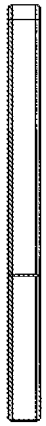
Figure 7C:
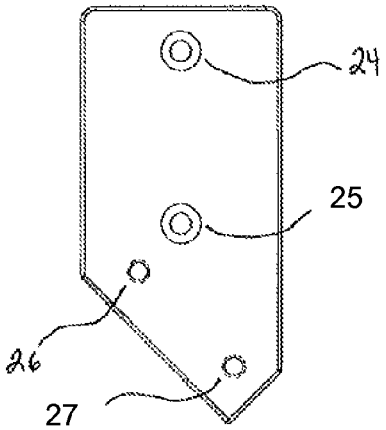
Figure 7D:
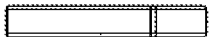
Figure 8C:
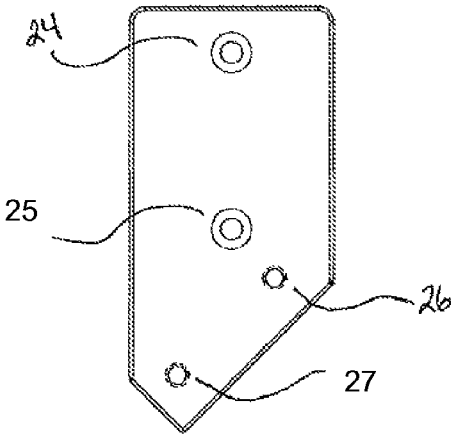
FIGS. 8A, 8B, 8C, and 8D show the vertical plate in the left-hand position.
Figure 8B:
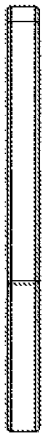
Figure 8A:
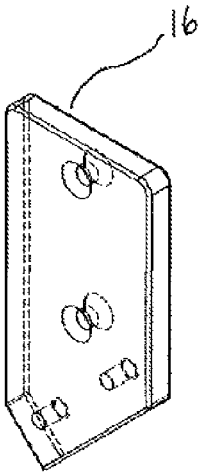
Figure 8D:
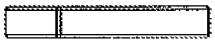
Figure 9C:
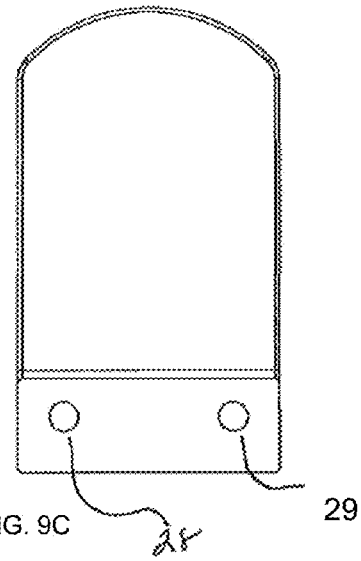
FIGS. 9A, 9B, 9C, and 9D show the angled plate.
Figure 9B:
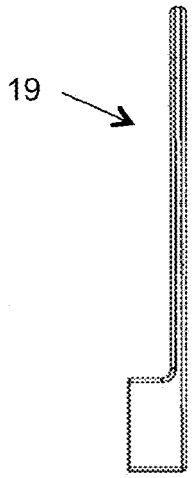
Figure 9A:
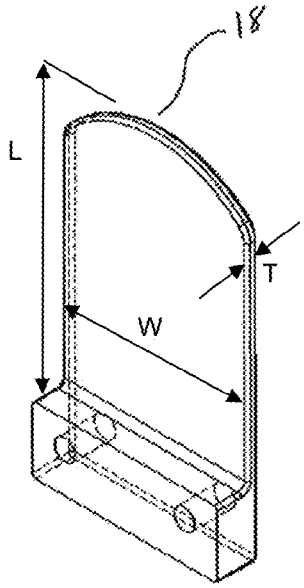
Figure 9D:
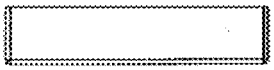
Figure 9E:
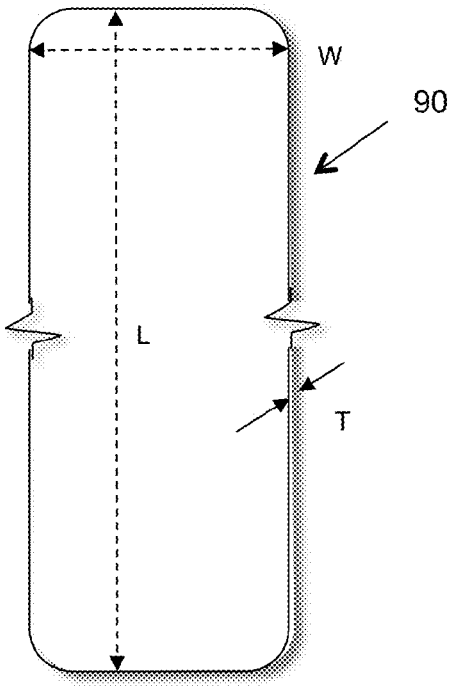
FIG. 9E shows an exemplary human belt 90
Figure 10A:
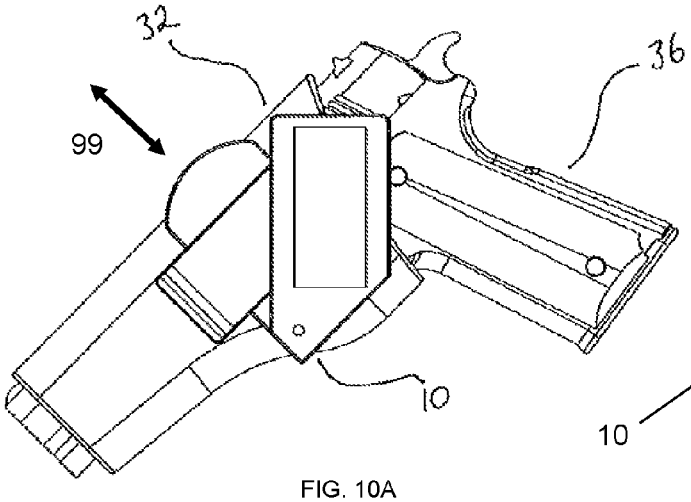
FIGS. 10A and 10B show a handgun and right-hand holster attached to the holster holder.
Figure 10B:
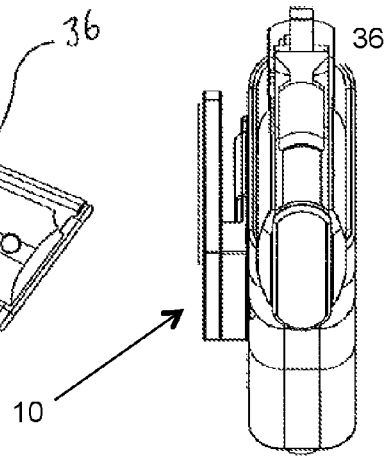
Figure 11B:
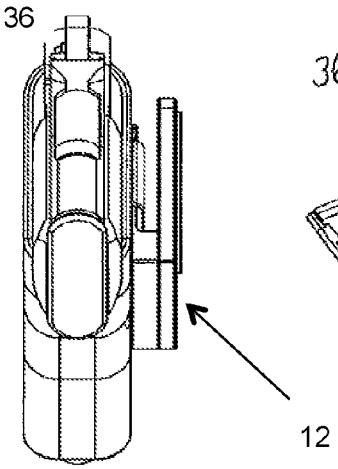
Figure 11A:
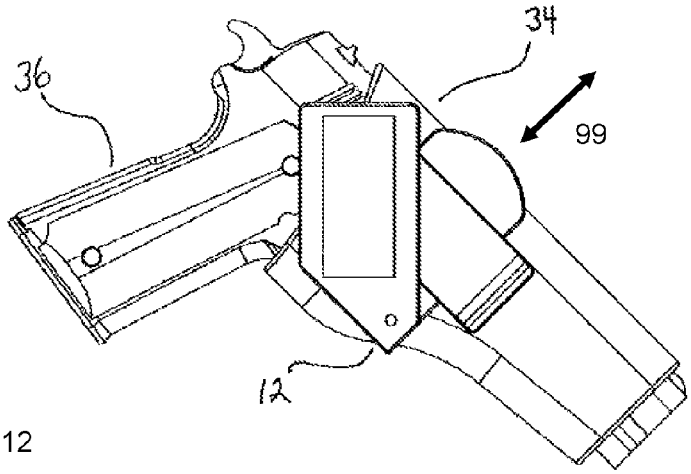

An angled holster support plate portion 18, can be approximately 2½" to approximately 3 1/16" long, approximately 1¼" to approximately 2" wide, and/or approximately ⅜" to approximately ¾" thick on one end and/or approximately 5/64" to approximately ⅛" thick on the other end:

a. is shown in a right-hand orientation in FIG. 3 and a reversed, left-hand orientation in FIG. 4;

b. can be sized to substantially replicate and/or mimic the width and/or thickness of a human waist belt 90 (each measured orthogonally to the length (longest dimension) of the belt—see FIG. 9E);

c. can slideably receive and/or accommodate a belt loop and/or belt clip of a holster at open end 13 and/or in a direction parallel to the length L of belt 90 by mimicking the width W (second longest orthogonal dimension of belt 90); and/or d. can non-destructively and/or releaseably attach to vertical plate portion 16 via one or more support fasteners, such as via two screws 20, 21 located at a closed mounting end 15 of the angled holster support plate portion 18 that is configured to limit the extent to which the holster, the belt loop, and/or the belt clip can slide down angled support plate portion 18.

One or more mounting fasteners, such as one or more pieces of double-sided tape 22, which can be sized approximately ¾" to approximately 2" wide and/or approximately 2" to approximately 3" long, and/or screws 30, 31, can be used to securely, non-destructively, non-releaseably, and/or releaseably attach a selected one of two dominant surfaces 41, 42 of reversible vertical plate portion 16 to an approximately vertical surface (the selected surface corresponding to a selected orientation of the holster holder (i.e., right-hand or left-hand)). Reversible vertical plate portion 16 can comprise one or more through-holes with countersinks on both sides of vertical plate portion (to accommodate it being reversed). For example, two approximately vertically aligned through-holes 24, 25 can be used to mount vertical plate portion 16 to an approximately vertical surface. As another example, two threaded through-holes 26, 27, which can be aligned on an angle ranging from approximately ±30 degrees to approximately ±60 degrees (including all values and sub-ranges therebetween), measured from vertical, such as an approximately ±forty-five degree angle, can allow angled plate portion 18 to be attached to vertical plate portion 16, in a selectable and reversible one of the right-hand orientation and the left-hand orientation. Angled plate portion 18 can comprise a thick section with two clearance through-holes 28, 29 that are configured to receive two button head screws 20, 21, which can attach angled plate portion 18 to vertical plate portion 16.

Angled plate portion 18 can comprise a stepped down or thin section 19 that can be sized similarly to belt 90 in thickness and/or width, which can enable it to easily yet securely receive, starting at open end 13 of holster holder 100, a belt loop and/or clip of a holster. Exposed corners of angled plate portion can be smoothed and/or rounded to avoid snagging the holster. Double-sided tape 22 can attach to either side of the vertical plate portion 16 and to an approximately vertical surface. Flat head screws 30, 31 can attach and/or assist in attaching vertical plate portion 16 to an approximately vertical surface.

FIGS. 10A, 10B, 11A, and 11B show views of a handgun 36 in a right-hand holster 32 supported by a right-hand holster holder 10 and a handgun 36 in a left-hand holster 34 supported by a left-hand holster holder 12.

Referring to FIGS. 1 through 9, the holster holder 100 can be assembled by passing screws 20, 21 through clearance holes 28, 29 in the angled plate portion 18 and screwing button head screws 20, 21 into threaded holes 26, 27 in vertical plate portion 16. Double-sided tape 22 can be attached to vertical plate portion 16 on the opposite side of vertical plate portion 16 from where angled plate portion 18 is attached. Using the other side of double-sided tape 22, the holster holder assembly 100 then can be attached to an approximately vertical surface, with the vertical plate portion aligned substantially vertically. Alternatively or in addition, holster holder assembly 100 can be attached to the approximately vertical surface using flat head screws 30, 31 inserted through counter-sunk through holes 24, 25 and into the approximately vertical surface.

Vertical plate portion 16 and/or angled plate portion 18 can be made of hard plastic (e.g., ABS, medium density polyethylene, high density polyethylene, polycarbonate, and/or polypropylene, etc.), wood, and/or metal (e.g., stainless steel, brass, aluminum, etc.), etc. Screws 20, 21 can be button-head screws or the like to prevent a snag by, or premature wear on, holster 32, 34.

Thus, certain exemplary embodiments can provide a system, machine, assembly, device, and/or manufacture, such as an ambidextrous and/or reversible holster holder, that can be reversibly configured for mounting a belt-attaching holster to an approximately vertical surface in either a right-hand arrangement or a left-hand arrangement, the belt-attaching holster potentially comprising a belt loop and/or a belt clip.

For example, certain exemplary embodiments can provide an assembly, comprising:

a mounting plate;

an angled holster support plate;

one or more support fasteners configured to non-destructively releaseably attach the angled holster support plate to the mounting plate; and/or one or more mounting fasteners configured to non-destructively releaseably attach the mounting plate to a substantially fixed surface;

etc.;

wherein:

the mounting plate is configured to be operably reversibly mounted, in an approximately vertical orientation, to an approximately vertical mounting surface;

the angled holster support plate is configured to operably attach to the mounting plate in a right-hand orientation of the assembly, the right-hand orientation defining a right-hand support angle for the angled holster support plate of from approximately 30 degrees to approximately 60 degrees from vertical;

the angled holster support plate is configured to operably attach to the mounting plate in a left-hand orientation of the assembly, the left-hand orientation defining a left-hand support angle for the angled holster support plate of from approximately −30 degrees to approximately −60 degrees from vertical;

the angled holster support plate operably defines a receiver portion having a width that approximates a width of a human waist belt, the receiver portion configured to slideably receive a holster in a direction parallel to a length of the human waist belt;

the receiver portion of the angled holster support plate is configured to slideably receive a holster belt loop or a holster belt clip;

the angled holster support plate defines a thickness that is approximately identical to a thickness of the human waist belt;

the angled holster support plate operably defines a closed mounting portion that is configured to prevent downward movement of a holster supported by the angled holster support plate;

the mounting plate defines a first dominant surface and an opposing second dominant surface;

the mounting plate is reversibly configured for the first dominant surface to operably and substantially contact the mounting surface in the right-hand orientation and for the second dominant surface to operably and substantially contact the mounting surface in the left-hand orientation;

the one or more support fasteners are configured to non-destructively releaseably attach the angled holster support plate to the mounting plate via one or more corresponding support fastener through-holes that extend through the angled holster support plate and are threaded from each of two major sides of the angled holster support plate;

the one or more support fasteners are configured to allow the holster belt loop or the holster belt clip to slide smoothly on the angled holster support plate without snagging;

the one or more mounting fasteners are configured to non-destructively releaseably attach the mounting plate to a substantially fixed surface via one or more corresponding mounting fastener countersunk through-holes that extend through the mounting plate; and/or the one or more mounting fasteners comprise double-sided tape;

etc.

DEFINITIONS

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

about—around and/or approximately.

above—at a higher level.

across—from one side to another.

activity—an action, act, step, and/or process or portion thereof adapt—to design, make, set up, arrange, shape, configure, and/or make suitable and/or fit for a specific purpose, function, use, and/or situation.

adapter—a device used to effect operative compatibility between different parts of one or more pieces of an apparatus or system.

after—following in time and/or subsequent to.

allow—to provide, let do, happen, and/or permit.

along—through, on, beside, over, in line with, and/or parallel to the length and/or direction of; and/or from one end to the other of and—in conjunction with.

and/or—either in conjunction with or in alternative to.

angle—an inclination of one line and/or plane relative to another line and/or plane.

angled—slanted with respect to an adjacent object and/or reference plane.

any—one, some, every, and/or all without specification.

apparatus—an appliance or device for a particular purpose.

approximately—about and/or nearly the same as.

approximates—is nearly the same as.

are—to exist.

around—about, surrounding, and/or on substantially all sides of; and/or approximately.

as long as—if and/or since.

assembly—a plurality of coupled components.

associate—to join, connect together, and/or relate.

at—in, on, and/or near.

at least—not less than, and possibly more than.

attach—to fasten, secure, couple, and/or join.

belt—a flexible band, often formed of leather and/or cloth, worn around the waist to support clothing, secure tools and/or weapons, and/or serve as decoration.

between—in a separating interval and/or intermediate to.

by—via and/or with the use and/or help of.

can—is capable of, in at least some embodiments.

cause—to bring about, provoke, precipitate, produce, elicit, be the reason for, result in, and/or effect.

clip—a weight bearing, securing, gripping, springably moveable, and/or motion restraining structural component configured to hold a first object near and/or together with respect to a second object, the component defining a gripping surface that, when engaging with or disengaging from the object-to-be-secured, not exceeding an elastic limit of or destroy any portion of the component.

closed—the result of closing, having boundaries, and/or enclosed.

composition of matter—a combination, reaction product, compound, mixture, formulation, material, and/or composite formed by a human and/or automation from two or more substances and/or elements.

comprising—including but not limited to.

configure—to design, arrange, set up, shape, and/or make suitable and/or fit for a specific purpose, function, use, and/or situation.

connect—to join or fasten together.

contact—to physically touch and/or come together.

containing—including but not limited to.

convert—to transform, adapt, and/or change.

corresponding—related, associated, accompanying, similar in purpose and/or position, conforming in every respect, and/or equivalent and/or agreeing in amount, quantity, magnitude, quality, and/or degree.

countersink—a hole with the top part enlarged so that the head of a screw and/or bolt will lie flush with or below the surface.

coupleable—capable of being joined, connected, and/or linked together.

coupling—linking in some fashion.

create—to bring into being.

define—to establish the meaning, relationship, outline, form, and/or structure of; and/or to precisely and/or distinctly describe and/or specify.

degree—a planar unit of angular measure equal in magnitude to 1/360 of a complete revolution.

derive—to receive, obtain, and/or produce from a source and/or origin.

determine—to find out, obtain, calculate, decide, deduce, ascertain, and/or come to a decision, typically by investigation, reasoning, and/or calculation.

device—a machine, manufacture, and/or collection thereof direction—a spatial relation between something and a course along which it points and/or moves; a distance independent relationship between two points in space that specifies the position of either with respect to the other; and/or a relationship by which the alignment and/or orientation of any position with respect to any other position is established.

dominant—major and/or greatest in size.

double-sided tape—a strip of material having two major adhesive surfaces, typically used for sealing, adhering, binding, and/or securing, etc.

downward—in, to, or toward a lower place, level, and/or position.

each—every one of a group considered individually.

effective—sufficient to bring about, provoke, elicit, and/or cause.

embodiment—an implementation, manifestation, and/or concrete representation.

estimate—(n) a calculated value approximating an actual value; (v) to calculate and/or determine approximately and/or tentatively.

exemplary—serving as an example, instance, and/or illustration.

extend—to reach spatially outward, stretch, cover, and/or span.

fastener—a restraint that attaches to something and/or holds something in place, such as a screw, bolt, hook and/or loop of a hook and loop fastener system, button, hook, catch, snap, latch, buckle, loop, tie, clamp, connector, coupler, link, band, zipper, releasable adhesive, plug and socket, and/or any other non-destructively releasable mechanism for attachment, and/or a glue, bond, weld, and/or any other permanent and/or destructively releasable mechanism for attachment.

first—an initial element in a set.

fixed—substantially secured and/or incapable of translating with respect to a related object.

for—with a purpose of.

from—used to indicate a source, origin, and/or location thereof further—in addition.

generate—to create, produce, give rise to, and/or bring into existence.

having—including but not limited to.

holster—a protective covering (such as for a handgun, knife, phone, and/or tool, etc.).

human—a member of, or substantially resembling a member of, the genus *Homo* and especially of the species *H. sapiens*.

identical—substantially similar.

including—including but not limited to.

initialize—to prepare something for use and/or some future event.

install—to connect or set in position and prepare for use.

into—to a condition, state, or form of.

is—to exist in actuality.

left-hand—of, relating to, and/or located on the left, and/or relating to, designed for, and/or done with the left hand.

length—a longest dimension of something and/or the measurement of the extent of something along its greatest dimension.

loop—something having a shape, order, and/or path of motion that is substantially circular and/or curved over on itself major—relatively great in size or extent.

may—is allowed and/or permitted to, in at least some embodiments.

method—one or more acts that are performed upon subject matter to be transformed to a different state or thing and/or are tied to a particular apparatus, said one or more acts not a fundamental principal and not pre-empting all uses of a fundamental principal.

more—a quantifier meaning greater in size, amount, extent, and/or degree.

mount—to couple, fix, and/or attach on and/or to something.

mounting plate—a substantially planar and/or rigid body configured to receive one or more devices and/or parts.

movement—a change in position from one location to another.

near—a distance of less than approximately [X].

no—an absence of and/or lacking any.

non-destructively—able to be removed without destroying and/or degrading a structural integrity of the item removed and/or the item from which it is removed, and/or of, relating to, and/or being a process that does not result in damage to the subject material and/or product and/or results in such minimal damage that the subject material and/or product can be re-used for its intended purpose.

one—being and/or amounting to a single unit, individual, and/or entire thing, item, and/or object.

operable—practicable and/or fit, ready, and/or configured to be put into its intended use and/or service.

opposing—opposite; against; being the other of two complementary or mutually exclusive things; placed or located opposite, in contrast, in counterbalance, and/or across from something else and/or from each other.

or—a conjunction used to indicate alternatives, typically appearing only before the last item in a group of alternative items.

orientation—a positioning of a first object relative to a second object and/or reference.

outside—beyond a range, boundary, and/or limit; and/or not within.

parallel—of, relating to, or designating curves or surfaces everywhere equidistant.

per—for each and/or by means of plate—(n) a substantially planar body having a thickness measured perpendicular to the plane that is relatively small in comparison to the width and length of the body.

plurality—the state of being plural and/or more than one.

portion—a part, component, section, percentage, ratio, and/or quantity that is less than a larger whole, and/or can be visually, physically, and/or virtually distinguishable and/or non-distinguishable.

pre-—a prefix that precedes an activity that has occurred beforehand and/or in advance.

predetermine—to determine, decide, and/or establish in advance.

prevent—to hinder, avert, and/or keep from occurring.

prior—before and/or preceding in time or order.

probability—a quantitative representation of a likelihood of an occurrence.

product—something produced by human and/or mechanical effort.

project—to calculate, estimate, or predict.

provide—to furnish, supply, give, and/or make available.

range—a measure of an extent of a set of values and/or an amount and/or extent of variation.

ratio—a relationship between two quantities expressed as a quotient of one divided by the other.

receive—to get as a signal, take, acquire, and/or obtain.

receiver—a device adapted to receive and/or support a corresponding object.

recommend—to suggest, praise, commend, and/or endorse.

reduce—to make and/or become lesser and/or smaller.
releaseably—capable of being substantially non-destructively freed from something that binds, fastens, and/or holds back.
remove—to eliminate, remove, and/or delete, and/or to move from a place or position occupied.
repeat—to do again and/or perform again.
repeatedly—again and again; repetitively.
request—to express a desire for and/or ask for.
result—(n.) an outcome and/or consequence of a particular action, operation, and/or course; (v.) to cause an outcome and/or consequence of a particular action, operation, and/or course.
reversibly—designed, made, and/or constructed so that either side can be used.
right-hand—of, relating to, and/or located on the right, and/or relating to, designed for, and/or done with the right hand.
said—when used in a system or device claim, an article indicating a subsequent claim term that has been previously introduced.
second—a cited element of a set that follows an initial element.
select—to make a choice or selection from alternatives.
set—a related plurality.
side—a surface bounding a solid object.
slide—to, in a smooth and/or continuous motion, move one object relative to another.
slideably—a smooth and/or continuous motion of one object relative to another.
smoothly—having a substantially even and/or gentle motion and/or movement.
snagging—being caught, hindered, impeded, torn, broken, and/or destroyed on and/or by one or more irregularities, roughnesses, and/or projections.
species—a class of individuals and/or objects grouped by virtue of their common attributes and assigned a common name; a division subordinate to a genus.
store—to place, hold, and/or retain data, typically in a memory.
substantially—to a great extent and/or degree.
support—to bear the weight of.
surface—the exterior and/or outer boundary and/or face of an object and/or a material layer constituting and/or resembling such a boundary.
system—a collection of mechanisms, devices, machines, articles of manufacture, processes, data, and/or instructions, the collection designed to perform one or more specific functions.
that—used as the subject or object of a relative clause.
thickness—the measure of the smallest dimension of a solid figure.
threaded—comprising a helical and/or spiral ridge used for advancing a shaft in a longitudinal direction, such as found on screws, nuts, and bolts.
through—across, among, between, and/or in one side and out the opposite and/or another side of.
through-hole—an aperture that extends through its object and/or defines substantially constant cross sectional shape along its longitudinal axis.
to—a preposition adapted for use for expressing purpose.
transform—to change in measurable: form, appearance, nature, and/or character.
transmit—to send as a signal, provide, furnish, and/or supply.
treatment—an act, manner, or method of handling and/or dealing with someone and/or something.
two—a cardinal number equal to one plus one.
upon—immediately or very soon after; and/or on the occasion of
use—to put into service.
vertical—substantially perpendicular to horizontal.
via—by way of, with, and/or utilizing.
waist—the part of the human trunk between the bottom of the rib cage and the pelvis.
weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.
when—at a time and/or during the time at which.
wherein—in regard to which; and; and/or in addition to.
width—a measure in a direction perpendicular to a length and a thickness.
with—accompanied by.
with regard to—about, regarding, relative to, and/or in relation to.
with respect to—about, regarding, relative to, and/or in relation to.
within—inside the limits of.
without—lacking
zone—a region and/or volume having at least one predetermined boundary.

Note

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects skilled artisans to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

- there is no requirement for the inclusion of any particular described characteristic, function, activity, substance, or structural element, for any particular sequence of activities, for any particular combination of substances, or for any particular interrelationship of elements;
- no described characteristic, function, activity, substance, or structural element is "essential";
- any two or more described substances can be mixed, combined, reacted, separated, and/or segregated;
- any described characteristics, functions, activities, substances, and/or structural elements can be integrated, segregated, and/or duplicated;
- any described activity can be performed manually, semi-automatically, and/or automatically;
- any described activity can be repeated, any activity can be performed by multiple entities, and/or any activity can be performed in multiple jurisdictions; and
- any described characteristic, function, activity, substance, and/or structural element can be specifically excluded, the sequence of activities can vary, and/or the interrelationship of structural elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any phrase (i.e., one or more words) appearing in a claim is followed by a drawing element number, that drawing element number is exemplary and non-limiting on claim scope.

No claim of this document is intended to invoke paragraph six of 35 USC 112 unless the precise phrase "means for" is followed by a gerund.

Any information in any material (e.g., a United States patent, United States patent application, book, article, etc.) that has been incorporated by reference herein, is incorporated by reference herein in its entirety to its fullest enabling extent permitted by law yet only to the extent that no conflict exists between such information and the other definitions, statements, and/or drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document.

What is claimed is:

1. An assembly, comprising:

a mounting plate;

an angled holster support plate; and one or more mounting fasteners configured to non-destructively releaseably attach the mounting plate to a substantially fixed surface;

wherein:

the mounting plate is configured to be operably reversibly mounted, in an approximately vertical orientation, to an approximately vertical mounting surface;

the angled holster support plate is configured to operably attach to the mounting plate in a right-hand orientation of the assembly, the right-hand orientation defining a right-hand support angle for the angled holster support plate of from approximately 30 degrees to approximately 60 degrees from vertical;

the angled holster support plate is configured to operably attach to the mounting plate in a left-hand orientation of the assembly, the left-hand orientation defining a left-hand support angle for the angled holster support plate of from approximately −30 degrees to approximately −60 degrees from vertical;

the angled holster support plate operably defines a receiver portion having a width that approximates a width of a human waist belt, the receiver portion configured to repeatedly smoothly slideably receive and release a holster:

over an open end of the receiver portion;

in a direction parallel to a length of the human waist belt; and without detachment of the angled holster support plate from the mounting plate; and the one or more mounting fasteners are configured to non-destructively releaseably attach the mounting plate to a substantially fixed surface via one or more corresponding mounting fastener countersunk through-holes that extend through the mounting plate.

2. The assembly of claim 1, wherein:

the receiver portion of the angled holster support plate is configured to slideably receive a holster belt loop or a holster belt clip.

3. The assembly of claim 1, wherein:

the angled holster support plate defines a thickness that is approximately identical to a thickness of the human waist belt.

4. The assembly of claim 1, wherein:

the angled holster support plate operably defines a closed mounting portion that is configured to prevent downward movement of a holster supported by the angled holster support plate.

5. The assembly of claim 1, wherein:

the mounting plate defines a first dominant surface and an opposing second dominant surface; and the mounting plate is reversibly configured for the first dominant surface to operably and substantially contact the mounting surface in the right-hand orientation and for the second dominant surface to operably and substantially contact the mounting surface in the left-hand orientation.

6. The assembly of claim 1, further comprising:

one or more support fasteners configured to non-destructively releaseably attach the angled holster support plate to the mounting plate.

7. The assembly of claim 1, further comprising:

one or more support fasteners configured to non-destructively releaseably attach the angled holster support plate to the mounting plate;

wherein:

the one or more support fasteners are configured to non-destructively releaseably attach the angled holster support plate to the mounting plate via one or more corresponding support fastener through-holes that extend through the angled holster support plate and are threaded from each of two major sides of the angled holster support plate.

8. The assembly of claim 1, further comprising:

one or more support fasteners configured to non-destructively releaseably attach the angled holster support plate to the mounting plate;

wherein:

the one or more support fasteners are configured to allow a holster belt loop or a holster belt clip to slide smoothly on the angled holster support plate without snagging.

* * * * *